US010383376B1

(12) United States Patent
Baldonado

(10) Patent No.: US 10,383,376 B1
(45) **Date of Patent: *Aug. 20, 2019**

(54) SAFETY VEST

(71) Applicant: Jimmy R Baldonado, Ventura, CA (US)

(72) Inventor: Jimmy R Baldonado, Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/851,448

(22) Filed: Dec. 21, 2017

Related U.S. Application Data

(63) Continuation of application No. 13/447,051, filed on Apr. 13, 2012, now Pat. No. 9,854,856.

(51) Int. Cl.

| | |
|---|---|
| ***A41D 31/32*** | (2019.01) |
| ***A41D 13/01*** | (2006.01) |
| ***A41D 1/04*** | (2006.01) |
| *A41D 31/04* | (2019.01) |

(52) U.S. Cl.
CPC ..... *A41D 13/01* (2013.01); *A41D 1/04* (2013.01)

(58) Field of Classification Search
CPC ..... A41D 13/0007; A41D 13/0518; A41D 13/0568; A41D 13/0012; A41D 13/01; A41D 13/015; A41D 13/05; A41D 1/04; A41D 31/005; A62B 35/0018; A63B 71/08
See application file for complete search history.

(56) References Cited

U.S. PATENT DOCUMENTS

| | | | | |
|---|---|---|---|---|
| 262,577 | A | 8/1882 | Day | |
| 1,640,654 | A | 8/1927 | Goldsmith et al. | |
| 2,385,315 | A | 9/1945 | Vanesse | |
| 2,417,888 | A | 3/1947 | Schuster | |
| 2,748,391 | A | 6/1956 | Lewis, Jr. et al. | |
| 2,986,738 | A | 6/1961 | Zubiate | |
| 3,354,470 | A | 11/1967 | Allen | |
| 3,514,786 | A | 6/1970 | Terwilliger | |
| 4,168,544 | A | 9/1979 | Kallman | |
| 4,322,859 | A | 4/1982 | Mitchell | |
| 4,507,801 | A | 4/1985 | Kavanagh et al. | |
| 4,590,622 | A | 5/1986 | Wolfe et al. | |
| 4,637,075 | A | 1/1987 | Ingrisano et al. | |
| 4,680,813 | A | 7/1987 | Glaeser | |
| 5,159,715 | A | 11/1992 | Jurga et al. | |
| 5,168,576 | A * | 12/1992 | Krent | A41D 13/0156 2/16 |
| 5,319,806 | A | 6/1994 | Hermann et al. | |
| 5,361,412 | A | 11/1994 | Perry | |
| 5,524,641 | A | 6/1996 | Battaglia | |
| 6,138,277 | A * | 10/2000 | Gillen | A41D 13/015 2/102 |

(Continued)

*Primary Examiner* — Robert H Muromoto, Jr.
(74) *Attorney, Agent, or Firm* — David L. Hoffman; Hoffman Patent Group

(57) ABSTRACT

A protective body vest is disclosed applicable to industrial and contractor related work for carrying heavy and irregular shaped objects on the user's shoulder. The vest is in the shape of a typical armless vest, but can be adapted to have long sleeves to protect the wearers' arms as well as his torso, neck and shoulder. The vest has thick variable type padding for the vest garment and has a combination hard and soft support for the shoulder pads. Reflective bands on the vest offer protection by giving notice to all around of the wearer's presence.

20 Claims, 3 Drawing Sheets

(56) References Cited

U.S. PATENT DOCUMENTS 6,446,273 B1* 9/2002 Gillen ..... A41D 13/0153 2/2.5
6,553,579 B1 4/2003 Gillen et al.
6,691,327 B1 2/2004 Meyer
6,826,782 B2 12/2004 Jordan
7,181,772 B2 2/2007 Gillen et al.
9,854,856 B1* 1/2018 Baldonado ..... A41D 1/04
2002/0073473 A1 6/2002 Bachner, Jr. et al.
2002/0152533 A1 10/2002 Lesley
2002/0189003 A1 12/2002 Babcock
2003/0079271 A1* 5/2003 Gillen ..... A41D 13/0153 2/102
2003/0079277 A1 5/2003 Gillen et al.
2003/0153222 A1* 8/2003 Miller ..... B63C 9/115 441/88
2004/0058598 A1* 3/2004 Miller ..... B63C 9/115 441/115
2004/0117890 A1 6/2004 Golle et al.
2005/0010987 A1 1/2005 Crye et al.
2006/0248627 A1* 11/2006 Austin ..... A41D 13/0012 2/102
2007/0199126 A1 8/2007 Mahony
2008/0067202 A1* 3/2008 Silva ..... A41D 13/01 224/148.2
2009/0320188 A1* 12/2009 Johnson ..... A62B 35/0018 2/455
2011/0038142 A1* 2/2011 Ritter ..... F21V 21/145 362/108
2011/0240705 A1* 10/2011 Landano ..... A45F 3/047 224/676
2011/0283446 A1* 11/2011 Baldauf ..... A41D 13/0007 2/462
2012/0017360 A1* 1/2012 Lonodn ..... A41D 13/0007 2/455
2014/0289929 A1* 10/2014 Stansberry ..... A41D 13/0012 2/102

* cited by examiner

SAFETY VEST

CROSS REFERENCE TO RELATED APPLICATION(S)

This application claims priority from and is a continuing application of U.S. patent application Ser. No. 13/447,051, filed Apr. 13, 2012, issuing as U.S. Pat. No. 9,454,856, which is a nonprovisional application from U.S. Provisional Patent Application Ser. No. 61/462,502, filed Feb. 3, 2011, all incorporated by reference herein.

BACKGROUND OF THE INVENTION

Field of the Invention

The invention relates generally to the field of safety equipment and clothing, and more particularly, the invention discloses a safety vest having reinforced padding for protecting the wearer from sustaining pain and injury on the job.

Description of the Related Art

Every day, thousands of professional contractors embark on a variety of construction and repair tasks. While many workers wear safety gear, there exists perhaps one area where safety gear is lacking however. That area has to do with protecting the neck and shoulders when transporting various goods customarily supported on a shoulder. Simply stated, many employed in construction occupations must transport a myriad of heavy equipment and supplies on the job, using their shoulders as a means of supporting and balancing the weight of these goods. Transporting these goods can be extremely taxing on the upper body, particularly the neck, shoulders, and back muscles, resulting in sore and bruised muscles, in transporting heavy equipment on the job. Injuries resulting from such work can hinder the worker's ability to successfully complete the task at hand, as well as compromise his or her overall health and well-being.

In particular U.S. Pat. No. 7,181,772 issued to Gillen describes one type of protective body vest, and in U.S. Pat. No. 6,691,327 issued to Meyer addresses a unique single shoulder protective vest with a single variable shoulder pad.

DESCRIPTION OF THE PREFERRED EMBODIMENT(S)

The following detailed description is of the best currently contemplated modes of carrying out exemplary embodiments of the invention. The description is not to be taken in a limited sense, but is made merely for the purpose of illustrating the general principles of the invention.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Figure 1:
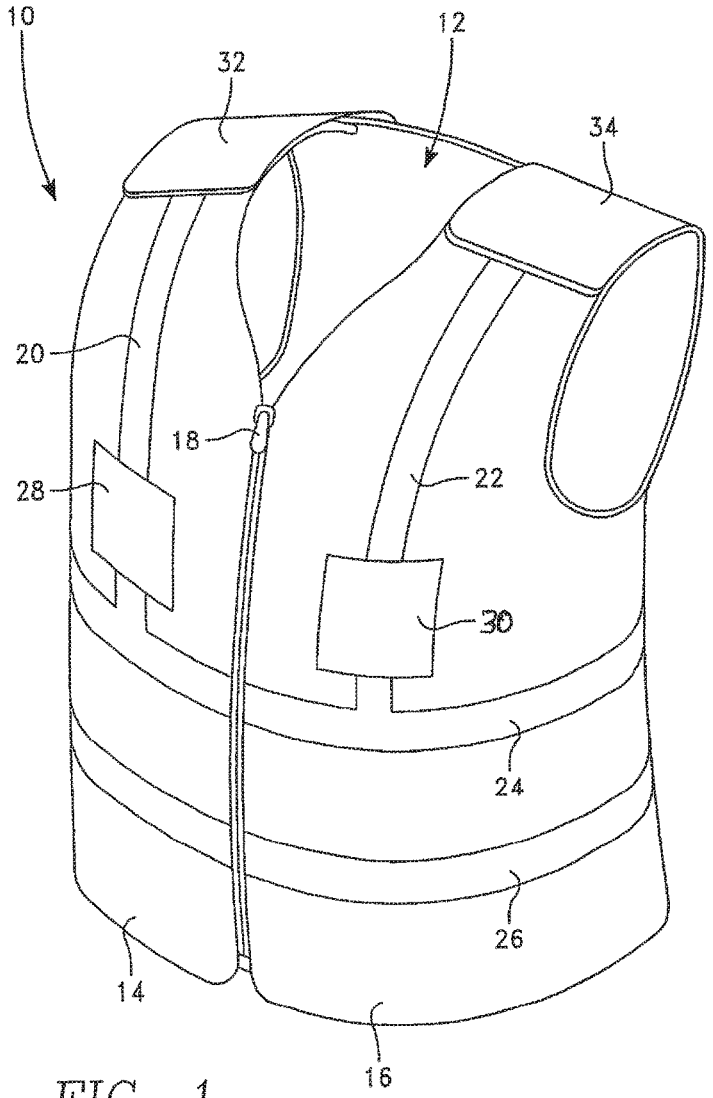
FIG. 1 depicts a perspective view illustrating one embodiment the invented safety vest constructed in accordance with the present invention.
Figure 2:
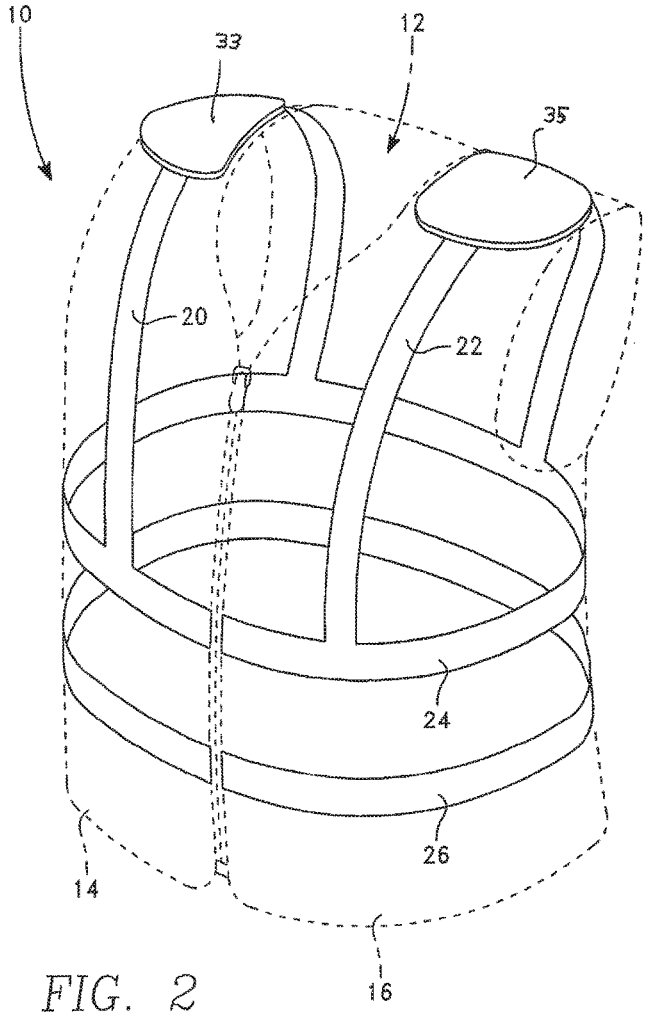
FIG. 2 illustrates a transparent perspective view of the safety vest of FIG. 1 showing the front, back and sides of the safety vest.
Figure 3:
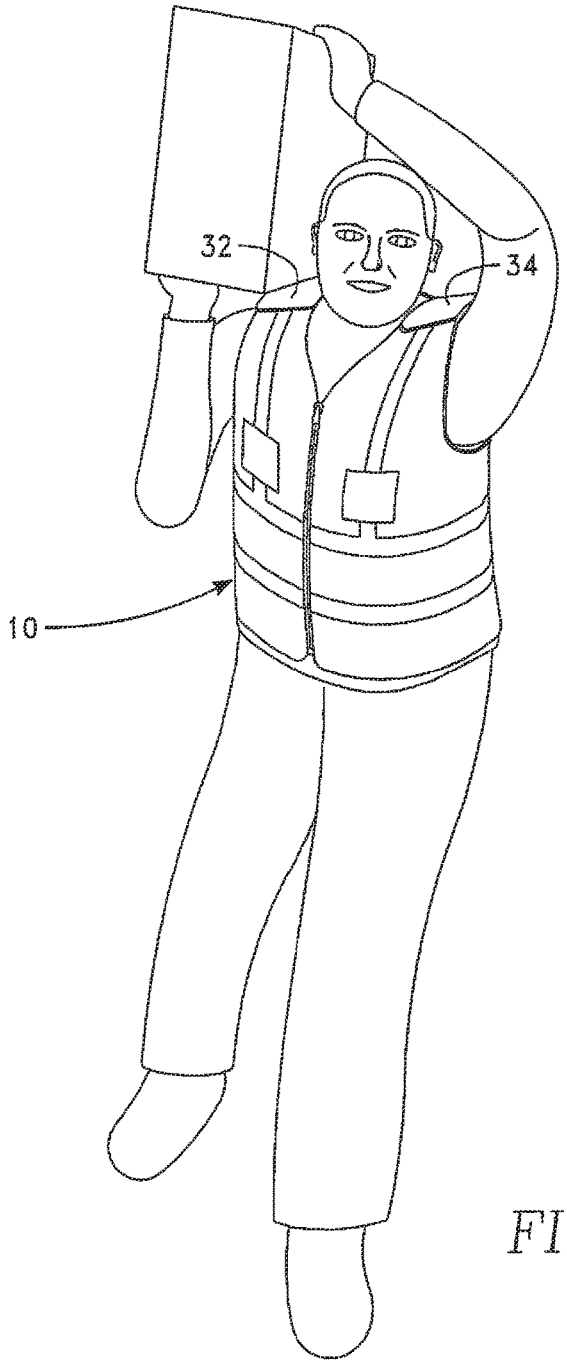
FIG. 3 demonstrates how the safety vest might be implemented in transporting heavy objects on a construction site.

As illustrated in FIGS. 1-3, the present invention is a safety vest having reinforced padding 10 for protecting the wearer from sustaining pain and injury on the job.

The safety vest of the present invention is double stitched and reinforced, and is preferably constructed primarily of heavy-duty, yet lightweight material such as canvas, nylon, or breathable mesh. The safety vest illustrated is a one piece, sleeveless vest featuring a solid back panel 12 and two chest panels 14 and 16 held comfortably closed over the chest by way of sturdy zipper 18 fastener running down the front of the unit. A long sleeve version of the vest is also envisioned. The vest can be produced in highly conspicuous florescent orange or florescent green hues. Running vertically down each side of the vest are reflective strips 20 and 22, and around the periphery 24 and 26 of the vest having a bright silver or comparable hue, thus further enhancing the visibility of the vest. Positioned on either front panel of the vest is a pair of ample storage pockets 28 and 30, inside of which the user can store any number of small supplies, goods or tools.

The most notable aspect of the safety vest of the present invention is found in the design of the shoulders of the vest. Incorporated into the design of either shoulder is a heavy duty shatterproof plastic or metal shoulder support pad 32 and 34 configured specifically to provide comfortable support of heavy items being transferred on the shoulder. Molded to accommodate the natural curves of the shoulders, the pads 32 and 34 will vary in depth/thickness and size dependant on the size of the user. The underside of each hard pad 32 and 34 has a generously padded cushion pad 33 and 35 such as malleable foam or rubber material, thus affording a comfortable barrier between the hard support pad and the body.

Application and use of the safety vest of the invention is very simple and straightforward. After purchasing a safety vest in the appropriate size, the user utilizes the vest on the job. Sliding the vest up and over the body, the user zips the front of the vest closed, making any necessary adjustments for a secure and comfortable fit. The user might then fill the vest pockets with items needed throughout the day, such as chalk, pencils, pens, snacks and tools. The user can then go about the designated tasks, utilizing the vest's integrated hard 32, 34, and soft 33, 35 (relative to the hard) shoulder pads to provide a comfortable barrier between the user and heavy or bulky items being transported. Carrying items in the traditional manner, FIG. 3, the user simply balances a length of rebar, plank of wood, or steel pipe on the shoulders, thereby allowing the vest's integrated shoulder pads to both support the weight of goods, as well as provide a protective barrier between the item and the shoulders and neck. After use, the vest is removed and stored away until again needed. As shown in and as evident from FIG. 3, the safety vest 10 is for exterior wear. In addition, as can be seen from FIG. 3, the shoulder pads extend for a substantial portion of the shoulder area of the vest. The shoulder pads are removably mounted to the safety vest at the defined shoulder area.

The safety vest disclosed herein provides a number of significant benefits and advantages. First and foremost, the safety vest offers professionals employed in various construction fields a practical way in which to protect their shoulder and neck when transporting heavy items. A lightweight and easily donned vest having integrated, heavy-duty shoulder pads 32 and 34 comfortably conforming to the shape of the shoulders with cushioned pads 33 and 35 enables users to transport items such a rebar, bricks, planks of wood, large blocks, and steel piping, balancing these objects behind the neck and on the shoulders, in a simple and comfortable manner. The safety vest also serves to absorb the shock and weight of heavy items, and thereby, vest enables those employed in construction fields to more safely and comfortably complete various aspects of their job. Ironworkers, pipefitters, bricklayers, and others will appreciate that wear of the vest effectively eliminates the sore and bruised neck and shoulder muscles so often associated with transporting heavy supplies. Improving worker safety, use of the vest can potentially reduce on site job related injuries, as well as the associated medical and insurance costs of these injuries. Manufactured with sheer comfort in mind and produced in a variety of sizes, the ergonomic design of the vest's support pads 32, 33 and 34, 35 ensures that regardless of the wearer's size, the vest snugly cushions the shoulders throughout the course of a busy day. Although designed with professionals in mind, amateur do-it-yourselfers will also appreciate the many benefits the vest affords.

Offering consumers a practical way in which to protect the neck and shoulders on the job, the safety vest invention enables wearers to complete a variety of construction tasks in comfort and with ease. Simple to use and durably constructed, the vests prove a valuable commodity in any work site.

The foregoing exemplary descriptions and the illustrated preferred embodiments of the present invention have been explained in the Drawing and described in detail in the foregoing Specification with varying modifications and alternative embodiments being taught. While the invention has been so shown, described and illustrated, it should be understood by those skilled in the art that equivalent changes in form and detail may be made therein without departing from the true spirit and scope of the invention. The scope of the present invention is to be limited only by the Claims except as precluded by the prior art. Moreover, the invention as disclosed herein, may be suitably practiced in the absence of the specific elements which are disclosed here.

What is claimed is:

1. A safety vest for exterior wear by a user for high visibility to others, the safety vest comprising:

a vest shaped torso enclosure having a front, a back, and a defined area for each shoulder for exterior wear over a user's torso;

the vest having reflective strips on the front and back for reflecting light to improve visibility of the vest and thereby of the user, wherein the vest is a substantially one piece sleeveless vest constructed primarily of lightweight material which is made in highly conspicuous fluorescent color; and shoulder pads disposed at each said defined area for providing weight distribution for comfortable support of items to be carried on a shoulder of a user.

2. The safety vest of claim 1, wherein the shoulder pads comprise an upper hard pad and a lower cushion pad softer than the hard pad.

3. The safety vest of claim 1, wherein the vest has pockets for storage of work related matter and non-work related matter.

4. The safety vest of claim 1, wherein the shoulder pads extend a substantial portion of the defined shoulder area.

5. The safety vest of claim 1, wherein the vest comprises nylon and the vest is primarily a breathable mesh.

6. The safety vest of claim 1, wherein the shoulder pads comprise a multi-layered pad having at least one soft, flexible, and compliant layer for contact with a shoulder of a user, and having a firm, non-flexible hard and non-compliant layer disposed on top of the soft layer for support of an object to be carried by a user.

7. The safety vest of claim 1, wherein the shoulder pads extend for most of the defined shoulder area and substantially all of the defined shoulder area in a direction extending from a neck opening to an arm opening.

8. The safety vest of claim 6, wherein the firm layer comprises hardened plastic for light weight support.

9. The safety vest of claim 1, wherein the shoulder pads are removably mounted to the safety vest at the defined shoulder area.

10. The safety vest of claim 1, wherein the vest shaped torso enclosure color has a green or orange hue.

11. A safety vest for exterior wear by a user for high visibility to others, the safety vest consisting essentially of:

a vest shaped torso enclosure having a front, a back, and a defined area for each shoulder for exterior wear over a user's torso;

the vest comprising a highly conspicuous fluorescent color for improved visibility of the vest and thereby of the user, wherein the vest is a one piece sleeveless vest constructed primarily of lightweight material;

a closure mechanism at the front of the vest for ease in putting the vest on; and shoulder pads disposed at each said defined area for providing weight distribution for comfortable support of items to be carried on a shoulder of a user.

12. The safety vest of claim 11, wherein the shoulder pads comprise an upper hard pad and a lower cushion pad softer than the hard pad.

13. The safety vest of claim 11, wherein the vest has pockets for storage of work related matter and non-work related matter.

14. The safety vest of claim 11, wherein the shoulder pads extend a substantial portion of the defined shoulder area.

15. The safety vest of claim 11, wherein the vest comprises nylon and the vest is primarily a breathable mesh.

16. The safety vest of claim 11, wherein the shoulder pads comprise a multi-layered pad having at least one soft, flexible, and compliant layer for contact with a shoulder of a user, and having a firm, non-flexible hard and non-compliant layer disposed on top of the soft layer for support of an object to be carried by a user.

17. The safety vest of claim 11, wherein the shoulder pads extend for most of the defined shoulder area and substantially all of the defined shoulder area in a direction extending from a neck opening to an arm opening.

18. The safety vest of claim 16, wherein the firm layer comprises hardened plastic for light weight support.

19. The safety vest of claim 11, wherein the shoulder pads are removably mounted to the safety vest at the defined shoulder area.

20. The safety vest of claim 11, wherein the vest shaped torso enclosure color has a green or orange hue.

* * * * *